US009402526B2

(12) United States Patent
Bertsch et al.

(10) Patent No.: US 9,402,526 B2
(45) **Date of Patent: *Aug. 2, 2016**

(54) DISHWASHER WITH SPRAY SYSTEM

(75) Inventors: Roger J. Bertsch, Stevensville, MI (US); Mark S. Feddema, Kalamazoo, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 891 days.

This patent is subject to a terminal disclaimer.

(21) Appl. No.: 13/570,361

(22) Filed: Aug. 9, 2012

(65) Prior Publication Data

US 2013/0074891 A1 Mar. 28, 2013

Related U.S. Application Data

(60) Provisional application No. 61/537,595, filed on Sep. 22, 2011.

(51) Int. Cl.

| | |
|---|---|
| ***A47L 15/22*** | (2006.01) |
| ***A47L 15/23*** | (2006.01) |
| ***A47L 15/42*** | (2006.01) |

(52) U.S. Cl.

CPC ..... *A47L 15/23* (2013.01); *A47L 15/4282* (2013.01)

(58) Field of Classification Search

CPC ..... A47L 15/23; A47L 15/4282; A47L 15/22; A47L 15/4278; A47L 15/4289

USPC ..... 134/198, 179, 56 D, 176, 172, 57 D, 134/58 D, 178, 103.2, 183; 239/251, 245, 239/227, 214, 240, 242, 261, 380

See application file for complete search history.

(56) References Cited

U.S. PATENT DOCUMENTS

| | | | |
|---|---|---|---|
| 3,064,664 | A | 11/1962 | Warhus |
| 3,146,953 | A | 9/1964 | Komanns |
| 3,253,784 | A | 5/1966 | Long et al. |
| 3,709,236 | A | 1/1973 | Field et al. |
| 3,771,725 | A | 11/1973 | Jenkins et al. |
| 3,797,509 | A | 3/1974 | Fukuzawa et al. |
| 3,918,644 | A | 11/1975 | Platt et al. |
| 4,266,565 | A | 5/1981 | Gurubatham |
| 4,509,687 | A | 4/1985 | Cushing |

(Continued)

FOREIGN PATENT DOCUMENTS

| | | |
|---|---|---|
| DE | 7024995 U | 6/1970 |
| DE | 4036930 A1 | 5/1992 |

(Continued)

OTHER PUBLICATIONS

European Search Report for Corresponding EP 12185510.0, Dec. 19, 2012.

(Continued)

*Primary Examiner* — David Cormier
*Assistant Examiner* — Thomas Bucci

(57) ABSTRACT

A dishwasher includes a tub at least partially defining a treating chamber and a spraying system for supplying liquid to the treating chamber. The spraying system includes a sprayer having a body with an interior, a liquid passage provided in the interior, and a plurality of outlets extending through the body and in fluid communication with the liquid passage.

27 Claims, 9 Drawing Sheets

(56) References Cited

U.S. PATENT DOCUMENTS

| | | | | |
|---|---|---|---|---|
| 4,993,444 | A | 2/1991 | Toriyama et al. | |
| 5,331,986 | A | 7/1994 | Lim et al. | |
| 5,415,350 | A | 5/1995 | Yoon et al. | |
| 5,427,129 | A | 6/1995 | Young, Jr. et al. | |
| 2,726,666 | A | 12/1995 | Oxford | |
| 5,546,968 | A | 8/1996 | Jeon et al. | |
| 5,577,665 | A | 11/1996 | Chang | |
| 5,601,100 | A | 2/1997 | Kawakami et al. | |
| 5,609,174 | A | 3/1997 | Ferguson | |
| 5,655,556 | A * | 8/1997 | Guerrera et al. | 134/176 |
| 5,662,744 | A | 9/1997 | Tuller et al. | |
| 5,673,714 | A | 10/1997 | Campagnolo et al. | |
| 5,697,392 | A | 12/1997 | Johnson et al. | |
| 5,944,037 | A | 8/1999 | Sinyong et al. | |
| 5,964,232 | A | 10/1999 | Chung | |
| 6,053,185 | A | 4/2000 | Beevers | |
| 6,325,083 | B1 | 12/2001 | Worter | |
| 7,314,188 | B2 | 1/2008 | Watson et al. | |
| 7,331,356 | B2 | 2/2008 | VanderRoest et al. | |
| 7,445,013 | B2 | 11/2008 | Vanderroest et al. | |
| 7,475,696 | B2 | 1/2009 | Vanderroest et al. | |
| 7,493,907 | B2 | 2/2009 | Roh | |
| 7,523,758 | B2 | 4/2009 | Vanderroest et al. | |
| 7,594,513 | B2 | 9/2009 | VanderRoest et al. | |
| 7,673,639 | B2 | 3/2010 | Shin | |
| 7,810,512 | B2 | 10/2010 | Pyo et al. | |
| 7,896,977 | B2 | 3/2011 | Gillum et al. | |
| 7,935,194 | B2 | 5/2011 | Rolek | |
| 7,959,744 | B2 | 6/2011 | Sundaram et al. | |
| 7,980,260 | B2 | 7/2011 | Bertsch et al. | |
| 8,113,222 | B2 | 2/2012 | Bertsch et al. | |
| 8,137,479 | B2 | 3/2012 | Vanderroest et al. | |
| 8,187,390 | B2 | 5/2012 | Vanderroest et al. | |
| 8,210,191 | B2 | 7/2012 | Gnadinger et al. | |
| 8,282,741 | B2 | 10/2012 | Bertsch et al. | |
| 2006/0278258 | A1 | 12/2006 | Kara et al. | |
| 2007/0056613 | A1 | 3/2007 | Haas et al. | |
| 2007/0289615 | A1 | 12/2007 | Shin | |
| 2009/0101182 | A1 | 4/2009 | Buesing et al. | |
| 2009/0101185 | A1 | 4/2009 | Pardini | |
| 2009/0159103 | A1 | 6/2009 | Gillum et al. | |
| 2010/0139719 | A1 * | 6/2010 | Gnadinger et al. | 134/56 D |
| 2011/0030742 | A1 | 2/2011 | Dalsing et al. | |
| 2011/0203619 | A1 | 8/2011 | Kara et al. | |
| 2011/0303250 | A1 | 12/2011 | Delgado et al. | |
| 2012/0279530 | A1 | 11/2012 | Thiyagarajan | |
| 2012/0279536 | A1 | 11/2012 | Adams et al. | |
| 2013/0074886 | A1 * | 3/2013 | Feddema et al. | 134/172 |
| 2013/0074888 | A1 | 3/2013 | Feddema | |
| 2013/0074890 | A1 | 3/2013 | Feddema et al. | |
| 2014/0054395 | A1 | 2/2014 | Heisele et al. | |
| 2014/0332041 | A1 | 11/2014 | Feddema | |

FOREIGN PATENT DOCUMENTS

| | | | |
|---|---|---|---|
| DE | 102005026558 | B3 | 11/2006 |
| DE | 102010043019 | A1 | 5/2012 |
| DE | 102011053666 | A1 | 5/2012 |
| EP | 0524102 | A1 | 1/1993 |
| EP | 0764421 | B1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1277430 | A1 | 1/2003 |
| EP | 1334687 | B2 | 8/2003 |
| EP | 1252856 | B1 | 9/2007 |
| EP | 2292134 | A1 | 3/2011 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |
| JP | 4033632 | A | 2/1992 |
| JP | 5184514 | A | 7/1993 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP 12185512.6, Dec. 6, 2012.

German Search Report for Counterpart DE102013111241.2, May 23, 2014.

European Search Report for Corresponding EP 12185514.2, Dec. 6, 2012.

European Search Report for Corresponding EP141770861, Oct. 20, 2014.

European Search Report for Corresponding EP14155441.0, May 30, 2014.

European Search Report for Corresponding EP141554444, May 6, 2014.

* cited by examiner

DISHWASHER WITH SPRAY SYSTEM

CROSS-REFERENCE TO RELATED APPLICATIONS

This application claims the benefit of U.S. Provisional Patent Application No. 61/537,595, filed Sep. 22, 2011, which is incorporated herein by reference in its entirety.

BACKGROUND OF THE INVENTION

Contemporary automatic dishwashers for use in a typical household include a tub and at least one rack or basket for supporting soiled utensils within the tub. A spraying system may be provided for recirculating liquid throughout the tub to remove soils from the utensils. The spraying system may include various sprayers including a rotatable spray arm.

SUMMARY

An embodiment of the invention relates to a dishwasher having a tub at least partially defining a treating chamber and a spraying system for supplying liquid to the treating chamber. The spraying system includes a rotatable spray arm having a body with an interior, a liquid passage provided in the interior, and a plurality of outlets extending through the body and in fluid communication with the liquid passage. The dishwasher also includes a valve body fluidly coupling the plurality of outlets to the liquid passage and moveable between at least two positions and an actuator operably coupled to the valve body and moving the valve body between the at least two positions based on the rotation of the rotatable spray arm.

DESCRIPTION OF EMBODIMENTS OF THE INVENTION

Figure 1:
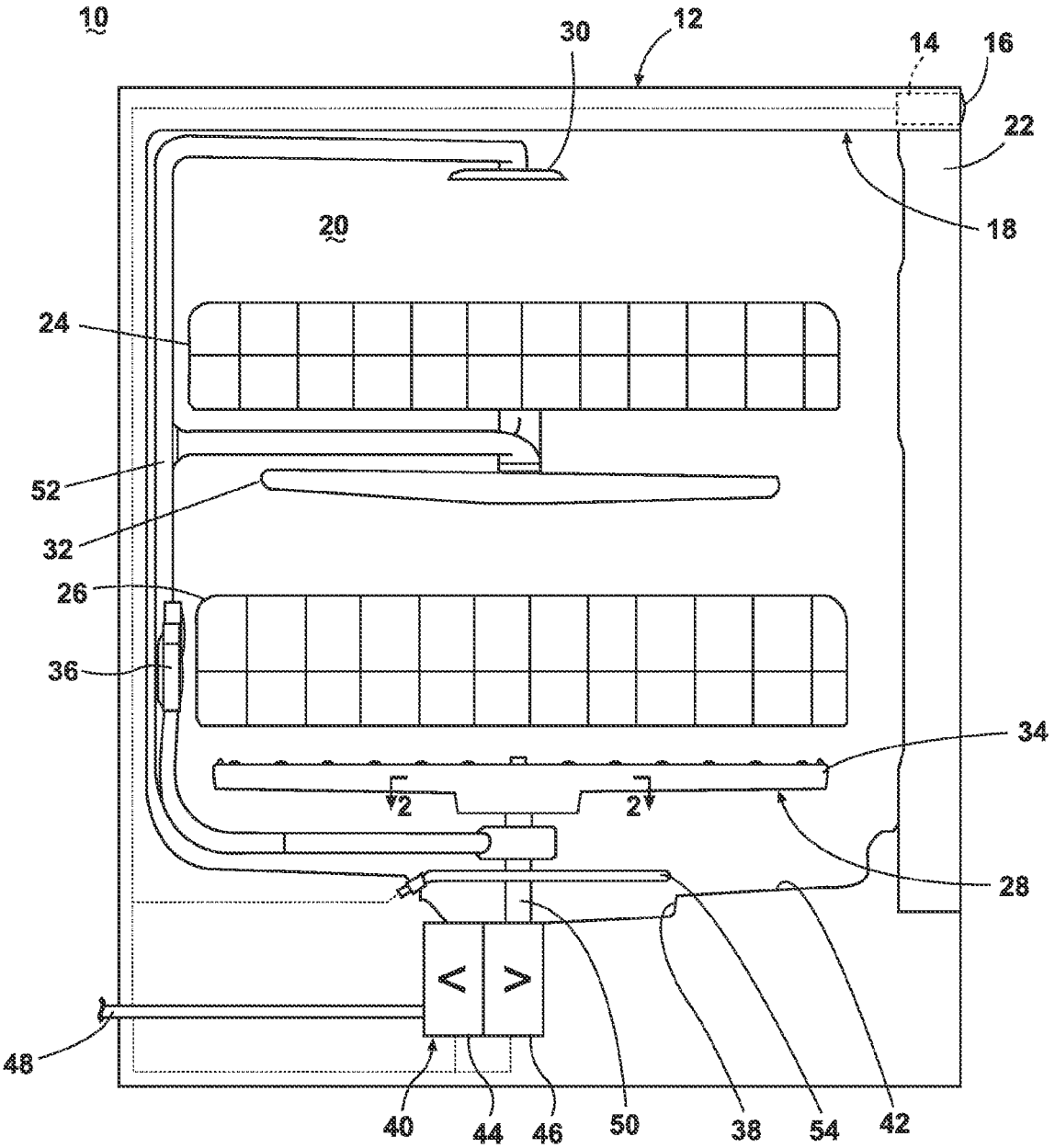
FIG. 1 is a schematic view of a dishwasher with a spray system according to a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any utensils positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
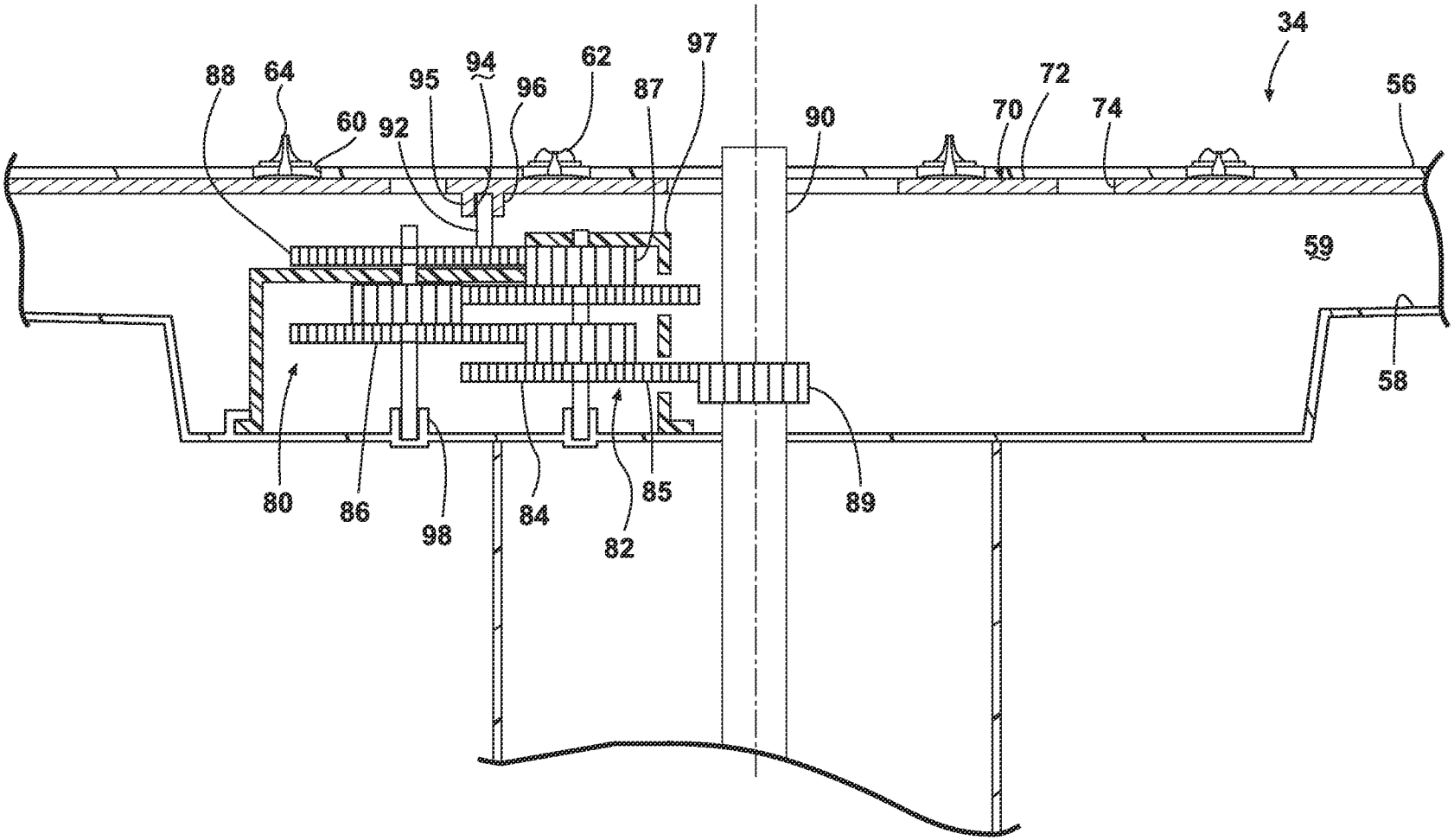
FIG. 2 is a cross-sectional view of a rotatable spray arm of the spray system of the dishwasher of FIG. 1 and illustrating a valve body for the rotatable spray arm.

FIG. 2 illustrates a cross-sectional view of the lower rotatable spray arm 34 comprising a body 56 having an interior 58. A liquid passage 59 may be provided in the interior 58 and fluidly couples with the outlet conduit 50 and recirculation pump 46. A plurality of outlets 60 extend through the body 56 and may be in fluid communication with the liquid passage 59. As illustrated, the interior 58 defines the liquid passage 59. However, a separate liquid passage 59 may be located within the interior 58.

Nozzles, such as nozzles 62 and 64, may be provided on the body 56 and may be fluidly coupled with the outlets 60, which lead to the liquid passage 58. Multiple nozzles 62 and 64 have been illustrated. The multiple nozzles 62 may correlate to a first subset of the plurality of outlets 60 and the multiple nozzles 64 may correlate to a second subset of the plurality of outlets 60. Nozzles 62 and 64 may provide different spray patterns, although this need not be the case. It is advantageous to do so to provide for different cleaning effects from a single spray arm. The first nozzle 62 may emit a first spray pattern (not shown), which may be a discrete, focused, and concentrated spray, which may provide a higher pressure spray. The second nozzle 64 may emit a second spray pattern (not shown), which may be a wide angle diffused spray pattern that produces more of a shower as compared to the more concentrated and discrete spray pattern produced by the first nozzle 62. The shower spray may be more suitable for distributing treating chemistry whereas the higher pressure spray may be more suitable for dislodging soils. It has been contemplated that the nozzles 62 and 64 may be arrange differently such that each type of nozzle 62, 64 may be included in both the first and second subsets of outlets 60.

A valve body 70 is illustrated as being located within the interior 56 and may be operable to selectively fluidly couple at least some of the plurality of outlets 60 to the liquid passage 59. More specifically, the valve body 70 has been illustrated as including a slidable plate 72 having multiple openings 74. The slidable plate 72 may be slidably mounted within the interior 58 of the body 56 of the rotatable spray arm 34 for movement between at least two positions. One position may allow the multiple openings 74 to fluidly couple the first subset of outlets 60 to the liquid passage 59 and the second position may allow the multiple openings 74 to fluidly couple the second subset of outlets 60 to the liquid passage 59. In this way, the different nozzles 62, 64 and/or different spray patterns may be selected with the sliding of the plate 72. Alternatively, the different subsets of outlets 60 may be located on different portions of the arms such that the selection of a particular subset of outlets 60 controls the location of the spray, regardless of whether the spray pattern is different. For example, one subset of outlets 60 may be located at the ends of the spray arm to direct liquid solely into the hard to reach areas of the treating chamber.

An actuator 80 may be operably coupled with the valve body 70 and may move the valve body 70 between the at least two positions based on the rotation of the rotatable spray arm 34. The actuator 80 may be any suitable mechanism capable of moving the valve body 70 between the at least two positions based on the rotation of the rotatable spray arm 34. By way of a non-limiting example, the actuator 80 may include a drive system 82 operably coupled with the rotatable spray arm 34 and the valve body 70 such that rotation of the spray arm 34 moves the valve body 70 between the at least two positions. The drive system 82 has been illustrated as including a gear assembly 84 operably coupling the rotatable spray arm 34 and the valve body 70 such that rotation of the rotatable spray arm 34 moves the gear assembly 84 which in turn moves the slidable plate 72 between the at least two positions. Thus, the gear assembly 84 helps convert the rotational motion of the spray arm 34 into sliding motion for the slidable plate 72. The gear assembly 84 has been illustrated as including a gear chain having a first gear 85, second gear 86, third gear 87, fourth gear 88, and a fixed gear 89. A fixed shaft 90 may extend through a portion of the body 56 such that the rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the valve body 70 to operably couple the gear assembly 84 with the slidable plate 72. The channel 94 may be a depression in a bottom portion of the slidable plate 72 or as illustrated may be formed between two opposing walls 95, 96 extending downwardly from the bottom of the slidable plate 72.

A bracket 97 may be located within the interior 58 and houses at least a portion of the gear assembly 84 to provide support for the gear assembly 84. Portions of the gear assembly 84 may also be held within supports 98 formed by the body 56 of the spray arm assembly 34.

The operation of the dishwasher 10 with the described spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

Figure 3A:
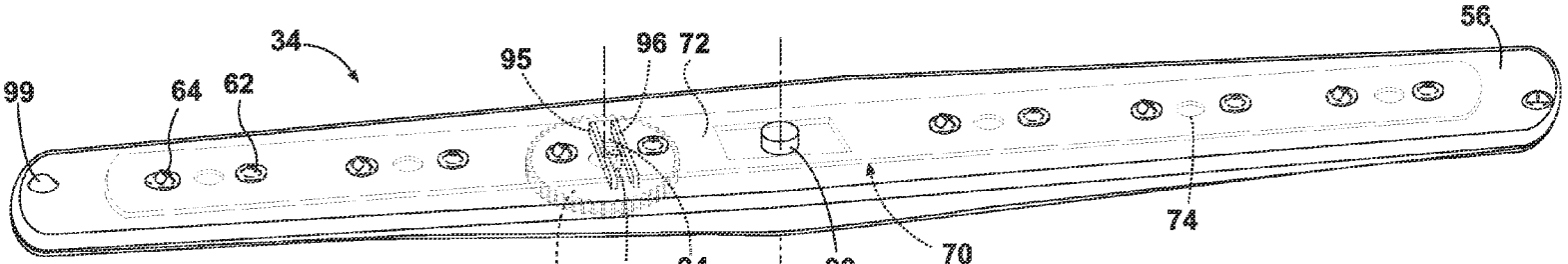
FIGS. 3A-3C are schematic views of the valve body in various positions within the rotatable spray arm of FIG. 2.

The lower rotatable spray arm 34 may rely on liquid pumped from the recirculation pump 46 to provide hydraulic drive to rotate the lower rotatable spray arm 34, which through the actuator 80 affects the movement of the valve body 70. More specifically, as illustrated in FIG. 3A, a hydraulic drive 99 may be formed by an outlet in the body 56 being oriented such that liquid emitted from the hydraulic drive outlet 99 effects the rotation of the lower rotatable spray arm 34. The lower rotatable spray arm 34 has been illustrated as having two hydraulic drive outlets 99 and these hydraulic drive outlets 99 are located such that when the recirculation pump 46 is activated, the lower rotatable spray arm 34 rotates regardless of the position of the valve body 70. It has also been contemplated that such hydraulic drive outlets 99 may be located on various portions of the body 56 including a side or bottom portion of the body 56. Alternatively, one or more of the multiple nozzles 62, 64 may form such hydraulic drive outlets.

As the lower rotatable spray arm 34 is hydraulically rotated about the fixed shaft 90, the first gear 85, which is mounted between the fixed gear 89 and the second gear 86, is rotatably mounted within the support 98, and moves with the rotation of the lower rotatable spray arm 34, may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88.

Figure 3B:
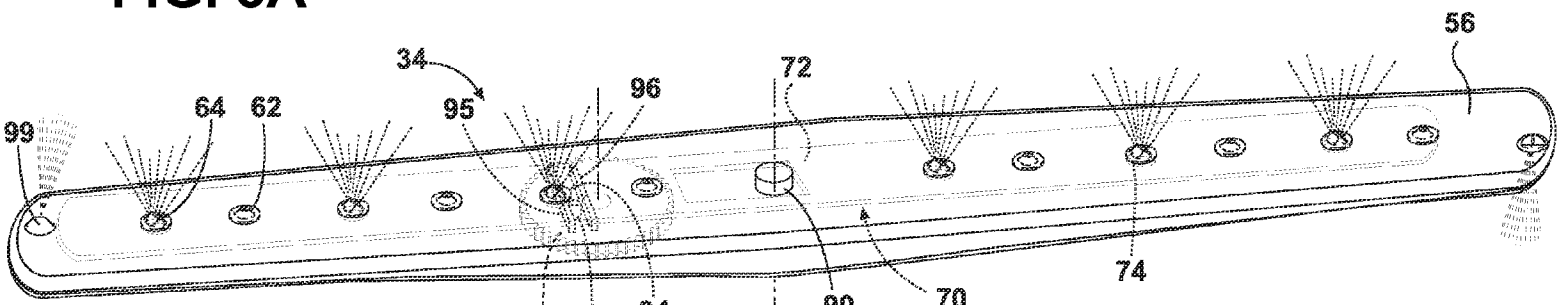
Figure 3C:
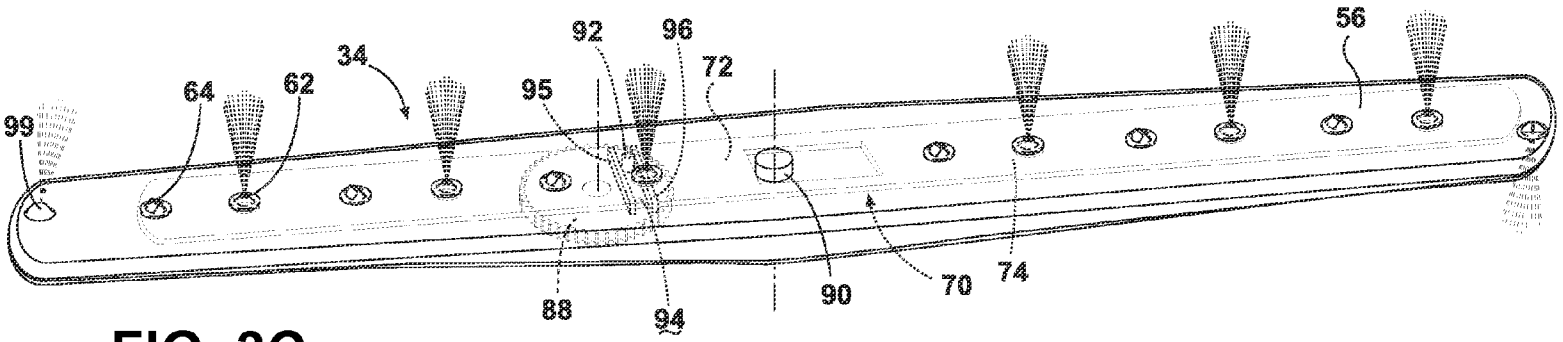

As the fourth gear 88 rotates, the pin 92 rotates within the interior 58 of the lower rotatable spray arm 34. As the pin 92 rotates, it moves within the boundaries of the channel 94 and causes the slidable plate 72 to be moved back and forth within the interior 58 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88. When the pin 92 pushes on the wall 95 it moves the slidable plate 72 to the first position illustrated in FIG. 3B. The slidable plate 72 may stay in the first position until the pin 92 is rotationally advanced to a point where it begins to push on the wall 96. When the pin 92 pushes on the wall 96 it moves the slidable plate 72 in the opposite direction until it reaches the second position illustrated in FIG. 3C. The slidable plate 72 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the slidable plate 72 into the first and second positions. In this manner, the movement of the pin 92 within the channel 94 operably couples the gear assembly 84 to the slidable plate 72 such that the rotation of the gear assembly 84 may be converted into translational movement of the slidable plate 72. Essentially, the actuator 80 allows the valve body 70 to move between the at least two positions based on a rotational position of the rotatable spray arm 34.

As the slidable plate 72 moves side to side inside the lower rotatable spray arm 34, the valve body 70 closes the fluid path to one of the first and second subsets of outlets 60 and opens a fluid path to the other of the first and second subsets of outlets 60. More specifically, as the slidable plate 72 moves within the lower rotatable spray arm 34, the multiple openings 74 may align with either the first and second subset of outlets 60. When the slidable plate 72 is in the first position, the multiple openings 74 are aligned with the first subset of outlets 60 correlating to the multiple nozzles 62 and in the second position the multiple openings 74 are aligned with the second subset of outlets 60 correlating to the multiple nozzles 64. Thus, as the valve body 70 moves relative to the lower rotatable spray arm 34, each of the first and second subsets of outlets 60 are sequentially fluidly coupled and uncoupled as the lower rotatable spray arm 34 rotates.

It has been contemplated that the valve body 70 may have additional openings or alternative openings such that the second subset of the plurality of outlets which are fluidly coupled with the liquid passage may only differ from the first subset by one of the outlets. It has also been contemplated that when the valve body 70 is located intermediately of the first and second positions, water may be still be sprayed from the plurality of outlets 60 if at least a portion of the multiple openings fluidly couples a portion of the plurality of outlets 60. It has also been contemplated that the valve body 70 may be shaped such that there may be a point where the outlets in the valve body 70 do not allow for the fluid to enter any of the plurality of outlets 60 except for the hydraulic drive outlets 99.

The gear chain of the gear assembly 84 is illustrated as forming a reduction gear assembly. That is the valve body 70 is moved between the at least two positions by the actuator 80 over multiple rotations of the lower rotatable spray arm 34. As illustrated, the reduction gear assembly may provide a 40:1 gear reduction such that the valve body 70 will slide to the first and second positions over forty revolutions of the lower rotatable spray arm 34. The gear ratios of the gear assembly 84 may be selected to control the relative movement of the valve body 70 to the lower rotatable spray arm 34. The gear ratio of the gear assembly 84 is a function of the ratios of gears forming the gear assembly 84. Thus, the gears may be selected to provide a desired ratio to provide a desired fluid coupling time between the fluid passage 59 and the first and second subsets of outlets 60. The gear reduction ratio may also be selected to aid in allowing the hydraulic drive outlets 99 to overcome the friction created by the valve body 70.

As the rotatable spray arm 34 turns, the valve body 70 continues to move between the first and second positions and continues to selectively fluidly couple the first and second subsets of outlets 60. The amount of time that the multiple openings 74 are fluidly coupled with each of the first and second subsets of outlets 60 controls the duration of the time that each of the nozzles 62, 64 spray liquid. The time of fluid coupling may be thought of as a dwell time. With the above described valve body 70 and actuator 80, the dwell time may be controlled by the gear ratio, the spacing between the two opposing walls 95, 96 extending around the pin 92, and the flow rate of liquid. The movement of the lower rotatable spray arm 34 and the valve body 70 ends when fluid is no longer pumped by the recirculation pump 46 to the lower rotatable spray arm 34 such that the lower rotatable spray arm 34 is no longer hydraulically driven.

It has also been contemplated that a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. Such a motor-driven spray arm is set forth in detail in U.S. Pat. No. 8,113,222, filed Dec. 16, 2008, and titled "Dishwasher with Driven Spray Arm for Upper Rack" and U.S. Pat. No. 7,980,260, filed Apr. 16, 2010, and titled "Dishwasher with Driven Rotatable Spray Arm," which are incorporated herein by reference in their entirety. If the lower rotatable spray arm 34 is motor operated, the valve body 70 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the multiple nozzles 62 and 64 in pre-selected areas of the treating chamber 20.

Figure 4:
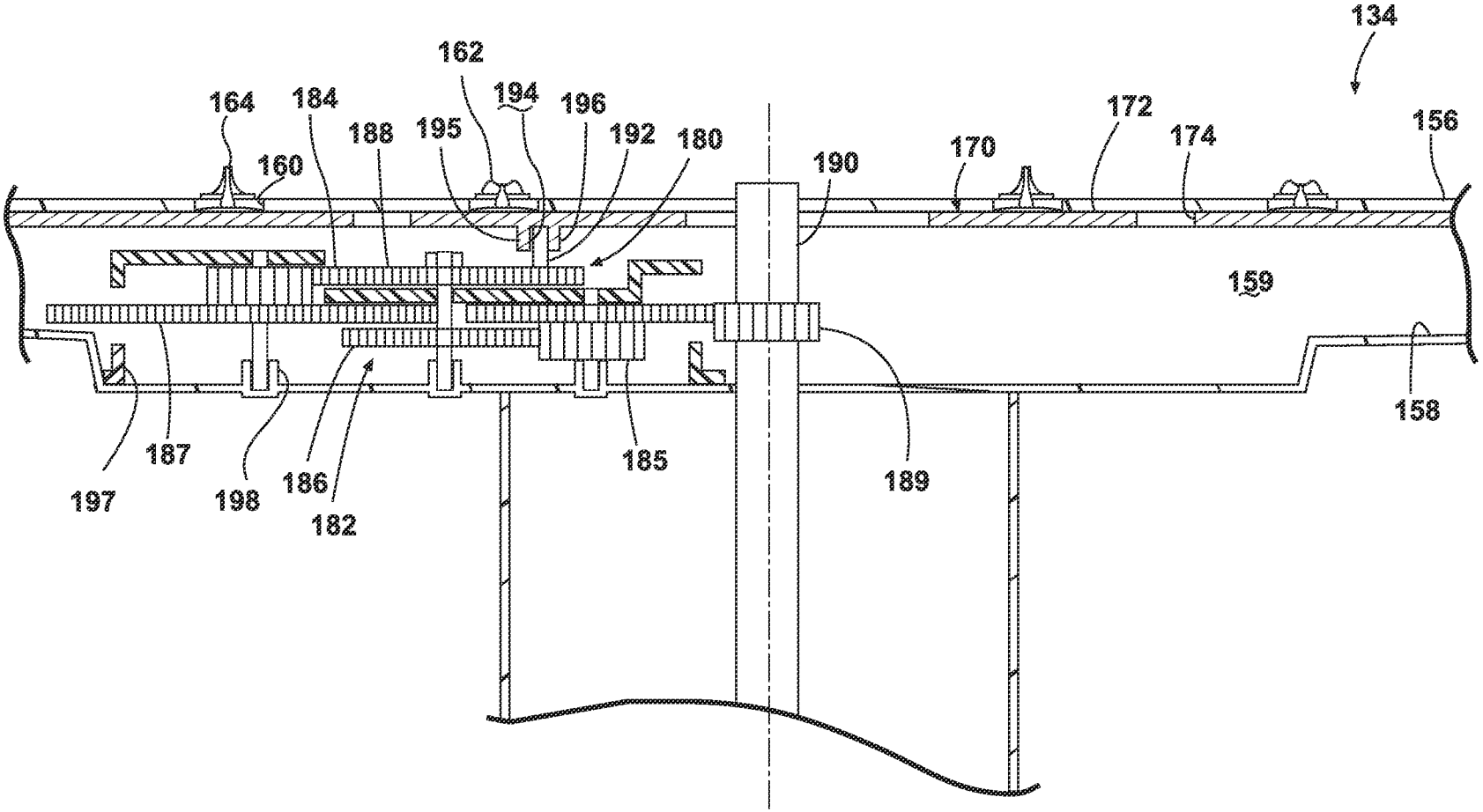
FIG. 4 is a cross-sectional view of a second embodiment of a lower spray arm, which may be used in the dishwasher of FIG. 1.

FIG. 4 illustrates a cross-sectional view of an alternative lower rotatable spray arm 134 according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

The differences between the lower rotatable spray arm 34 and the lower rotatable spray arm 134 include that the lower rotatable spray arm 134 has been illustrated as having a lower profile body 156, an alternative gear assembly 184, and an alternative bracket 197, which is configured to accommodate the alternative gear assembly 184. During operation, the lower rotatable spray arm 134, valve body 170, and actuator 180 operate much the same as in the first embodiment wherein as the lower rotatable spray arm 134 is rotated, the gears in the gear assembly 184 are driven and the slidable plate 172 is moved between the first and second positions. However, the gear assembly 184 is configured to provide a larger gear reduction, namely a 73:1 gear reduction, such that the valve body 170 will slide to the first and second positions over 73 revolutions of the lower rotatable spray arm 134. Thus, the dwell time or fluid coupling time between the fluid passage 159 and the first and second subsets of outlets 160 is greater than in the first embodiment. Further, the lower profile body 156 may increase the space available in the treating chamber 20 for holding utensils to be treated.

Figure 5:
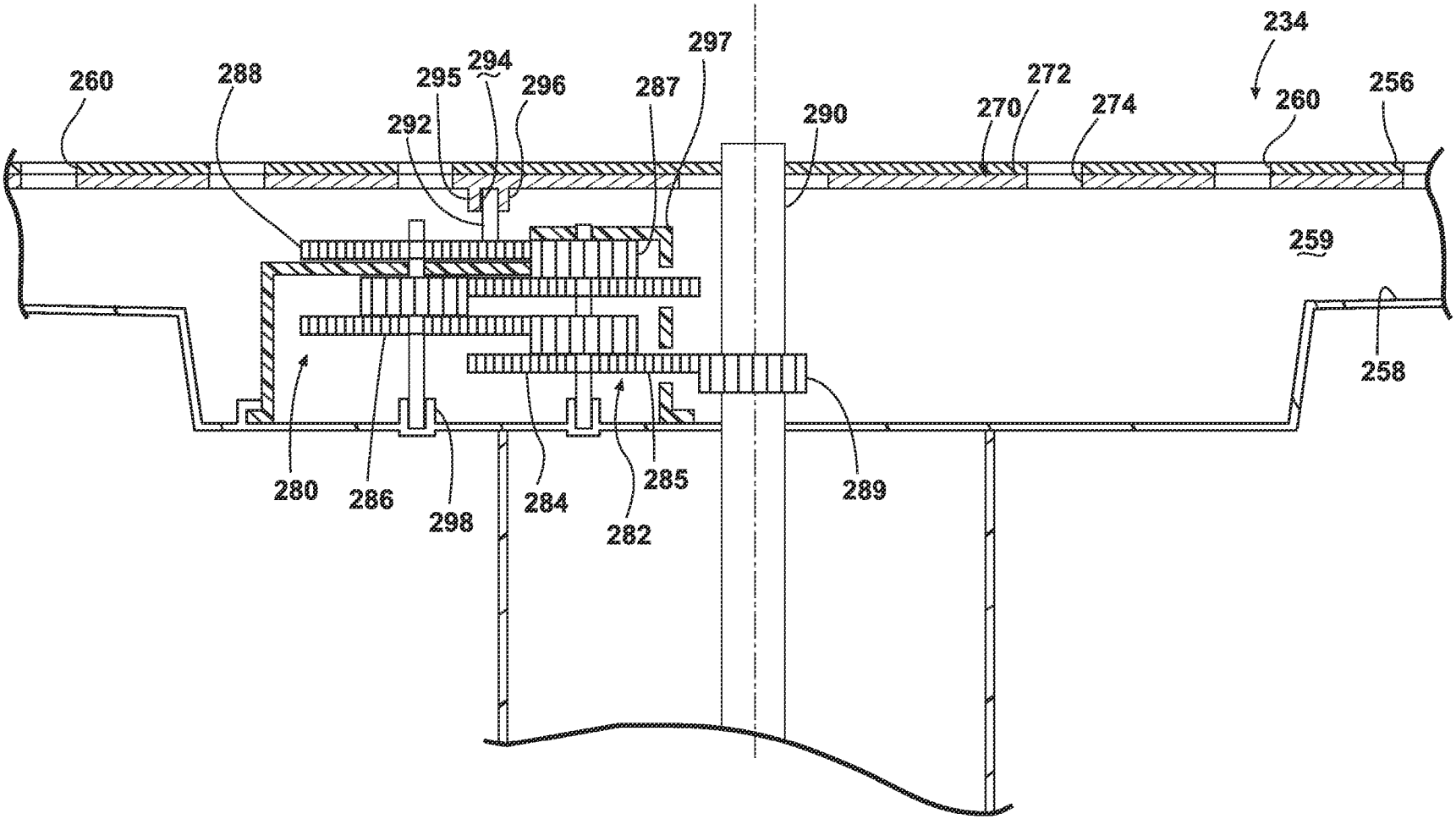
FIG. 5 is a cross-sectional view of a third embodiment of a lower spray arm, which may be used in the dishwasher of FIG. 1.

FIG. 5 illustrates a cross-sectional view of an alternative lower rotatable spray arm 234 according to a third embodiment of the invention. The lower rotatable spray arm 234 is similar to the lower rotatable spray arm 34 previously described and therefore, like parts will be identified with like numerals increased by 200, with it being understood that the description of the like parts of the lower rotatable spray arm 34 applies to the lower rotatable spray arm 234, unless otherwise noted.

One difference between the lower rotatable spray arm 34 and the lower rotatable spray arm 234 is that the plurality of outlets 260 form the nozzles for the spray arm 234 and no additional nozzle structures are provided on the body 256. Further, each of the outlets 260 is illustrated as having an identical configuration, such that there are no first and second subsets of outlets 260 as in the first embodiment. Alternatively however, the outlets 260 can be configured to provide different spray patterns, similar to the first embodiment. Another difference is that the slidable plate 272 of the valve body 270 has the same number of openings 274 as there are nozzle outlets 260. The slidable plate 272 may be slidably mounted within the interior 258 of the rotatable spray arm 234 for movement between at least two positions, and both positions may result in the multiple openings 274 being fluidly coupled with the multiple outlets 260. The valve body 270 may be formed such that the multiple openings 274 only partially close off a portion of the outlet 260 as the slidable plate 272 is moved between the first and second positions. In this manner, each paired outlet 260 and opening 274 may collectively form an effective opening or nozzle, and the slidable plate 272 may move to adjust the relative positions of the outlets 260 and opening 274 to alter the shape of the effective nozzle to control the shape of the spray and direction of liquid emitted from the outlet 260.

Figure 6A:
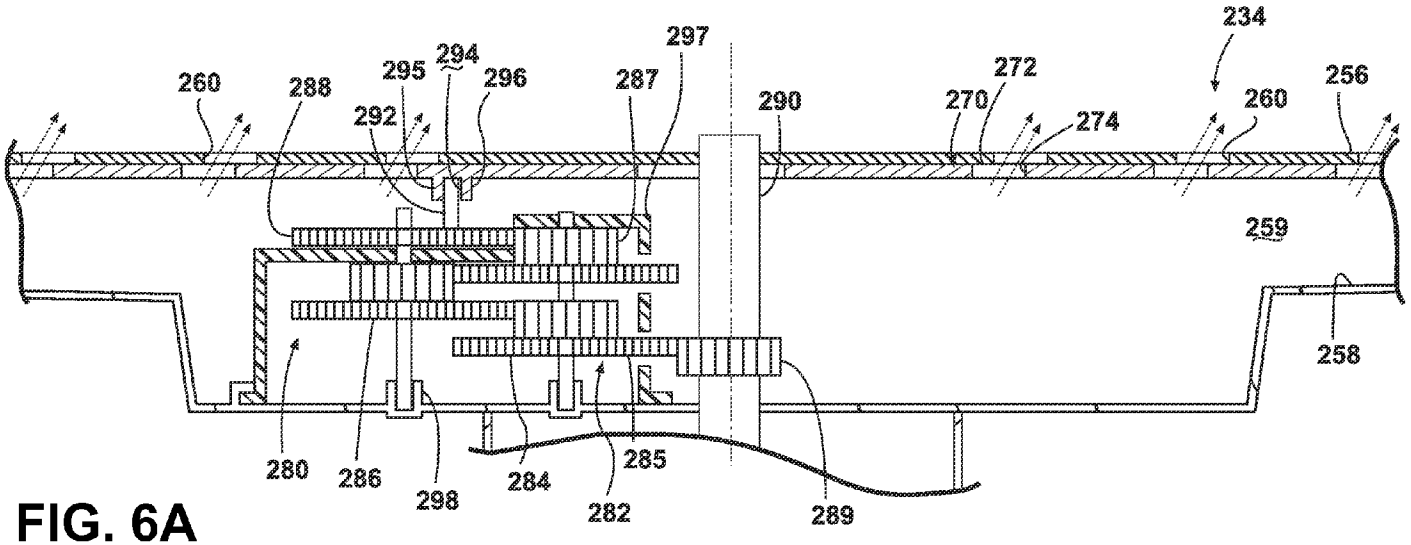
FIGS. 6A-6B are cross-sectional views of a valve body in various positions within the rotatable spray arm of FIG. 5.
Figure 6B:
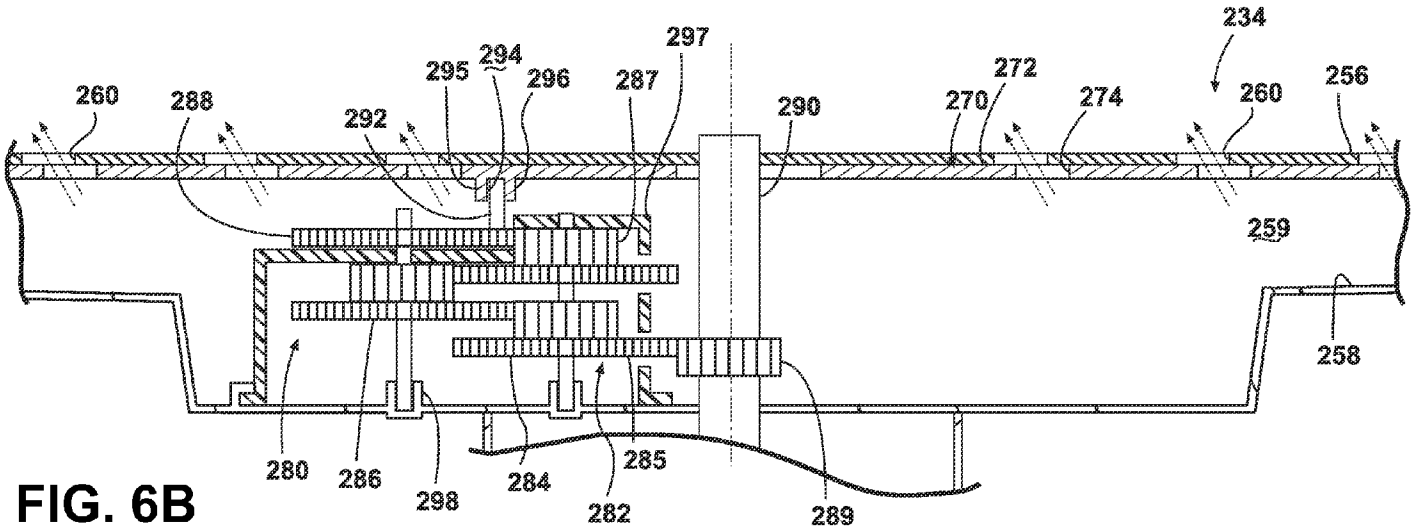

FIG. 6A illustrates a spray pattern that may be created when the slidable plate 272 is in the first position and FIG. 6B illustrates a spray pattern that may be created when the slidable plate 272 is in the second position. During operation, the lower rotatable spray arm 234, valve body 270, and actuator 280 operate much the same as in the first embodiment wherein as the lower rotatable spray arm 234 is rotated, the gears in the gear assembly 284 are driven and the slidable plate 272 is moved between the first and second positions. Alternatively, the rotatable spray arm 234 can be provided with a gear assembly similar to that of the second embodiment to achieve a higher gear reduction and longer dwell time.

As the slidable plate 272 is moved, the spray pattern from the outlets 260 is altered by the translation of the openings 274, which acts to change the flow of liquid from the outlet 260 by both reducing the size and changing the shape of the effective nozzle formed by the outlet 260 and opening 274. One result is that the direction of the liquid spraying from the outlets 260 is varied with the movement of the slidable plate 272. When the plate 272 is in the first position as shown in FIG. 6A, liquid may be sprayed out of the outlets 260 in a first direction generally toward one distal end of the spray arm 234 for a fixed number of revolutions. Likewise, when the plate 272 is in the second position as shown in FIG. 6B, liquid may be sprayed out of the outlets 260 in a second direction, different than the first direction, generally toward the other distal end of the spray arm 234 for a fixed number of revolutions. Depending on the configuration of the outlets 260 and openings 274, the first and second directions may be separated by an arc ranging between 45° and 120°. Furthermore, while not illustrated herein, as the plate 272 transitions between the first and second positions, liquid may be sprayed out of the outlets 260 in at least one, and possibly many, intermediate direction, generally upward from the spray arm 234 for a fixed number of revolutions. The actual time or amount of revolutions that the liquid is sprayed in each direction may be altered based on the design of the lower rotatable spray arm 234, valve body 270, spacing between the walls 295, 296, pin location 292, slot length 274, and gear assembly 284.

The force and shape of the pattern of the sprays emitted from the outlets 260 may also change with movement of the slidable plate 272. As the openings 274 come into alignment with the outlets 260, the effective nozzle becomes wider, and a more diffused, wide-angle spray pattern may be emitted from the effective nozzle that produces a shower spray of liquid from the spray arm 234. Conversely, as the outlets 260 are overlapped with the solid plate portion of the slidable plate 272, the effective nozzle becomes smaller, and a more discrete, focused, and concentrated the spray pattern may be emitted from the effective nozzle, which may provide a higher pressure spray from the spray arm 234. The shower spray may be more suitable for distributing treating chemistry whereas the higher pressure spray may be more suitable for dislodging soils. The different spray patterns, including the differing directions of spray, created by the third embodiment may provide for different cleaning effects from the single spray arm 234. Although the lower rotatable spray arm 234 has been described as being similar to the first embodiment it is contemplated that the profile and gear assembly 284 of the spray arm 234 may alternatively be formed like that disclosed with respect to the second embodiment.

Figure 7:
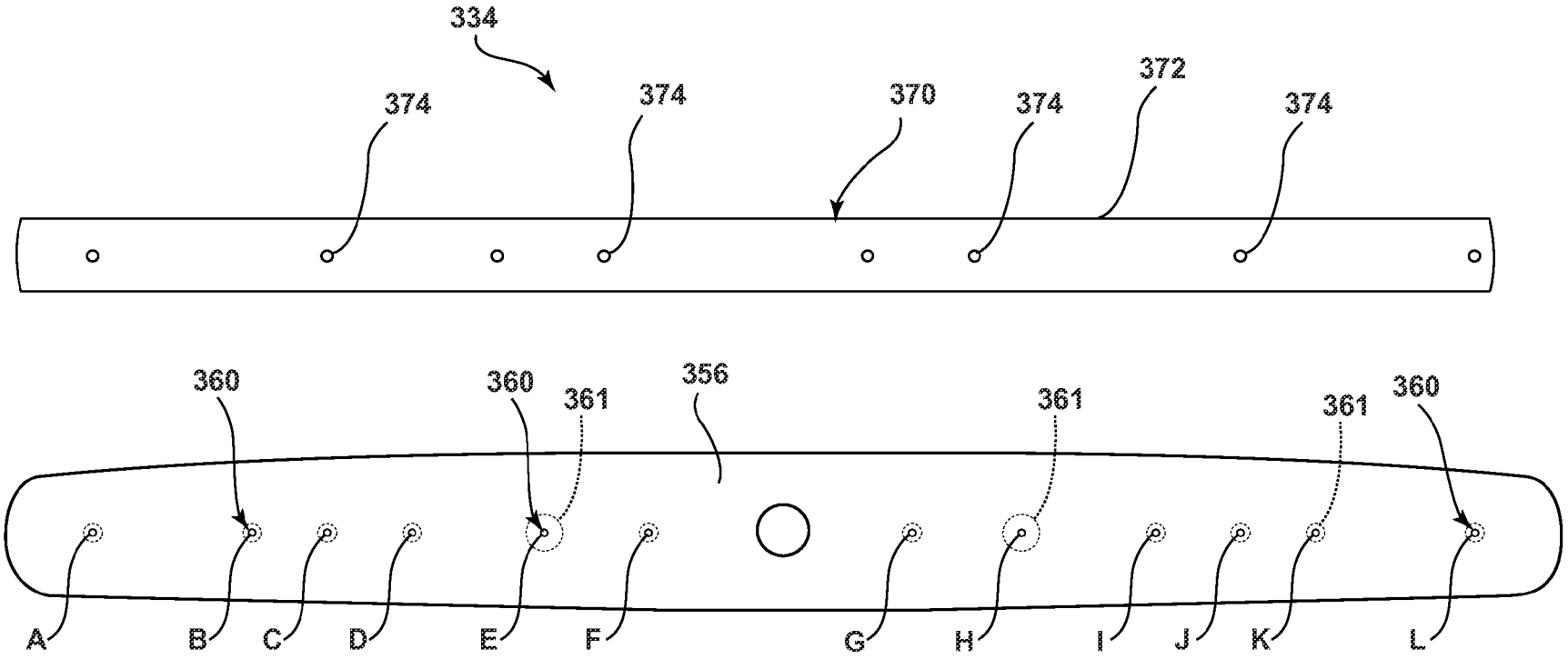
FIG. 7. is a schematic exploded view of a fourth embodiment of a lower spray arm, which may be used in the dishwasher of FIG. 1.

It is also contemplated that the pressure of the spray may be changed by varying the number of nozzles open and/or varying the open area of the nozzles. FIG. 7. illustrates an exploded view of a fourth embodiment of an alternative lower rotatable spray arm 334 and a valve body 370 according to a fourth embodiment of the invention. The lower rotatable spray arm 334 and valve body 370 are similar to the lower rotatable spray arm 34 and valve body 70 previously described and therefore, like parts will be identified with like numerals increased by 300, with it being understood that the description of the like parts applies to the fourth embodiment, unless otherwise noted.

One difference between the lower rotatable spray arm 34 and the lower rotatable spray arm 334 is that the lower rotatable spray arm 334, along with the valve body 370, is capable of varying the pressure of liquid emanating from the outlets 360 by varying the number of outlets 360 open and/or varying the open area of the outlets 360. In the first embodiment, if the same number of outlets remained open at each phase or the open area of the outlets did not change at each phase, then the nozzles were balanced and the pressure of liquid emanating from the nozzles did not change. The lower rotatable spray arm 334 is configured to vary the number of open nozzles and/or vary the cumulative open area of the nozzles during any one phase and as a result, the pressure from the nozzles may be varied throughout the cycle of operation.

In the illustrated example, the lower rotatable spray arm 334 includes a plurality of nozzles or outlets 360, which have been denoted further with letters ranging from A-L and extend through the body 356 of the lower rotatable spray arm 334. Each of the outlets 360 may be in fluid communication with a liquid passage (not shown) of the lower rotatable spray arm 334. More specifically, the outlets 360 may be fluidly coupled with the liquid passage within the lower rotatable spray arm 334 through movement of the valve body 370 similar to the embodiments described above. Although not illustrated, each of the outlets 360 may have a corresponding nozzle provided on the body 356.

It should be noted that the outlets 360 may be spaced in any variety of suitable manners along the lower rotatable spray arm 334 including that the outlets 360 may be offset from each other. In the illustrated example, a sealing ring 361 is included along an inner portion of the body 356 around each outlet 360. Such a sealing ring 361 may allow an opening 374 in the valve body 370 to fluidly couple with the outlet 360 so long as the opening 374 is at least partially within the sealing ring 361. The sealing ring may take any suitable form including that of an O-ring or other seal. The valve body 370 may be capable of sealing against the body 356 and the sealing rings 361 to better seal the outlets 360 against the unintended flow of liquid from the liquid passage. The outlets 360 have all been shown as being identical except that outlets E and H include a larger sealing ring 361 allowing outlets E and H to be coupled to the liquid passage for a longer time. Outlets E and H also include a slight larger outlet opening. However, it is contemplated that each of the outlets 360 may alternatively have an identical configuration. Further, the outlets 360 may be configured to provide for the same or different spray patterns as described in the above embodiments.

Another difference is that the slidable plate 372 of the valve body 370 has fewer openings, which are illustrated as eight openings. The slidable plate 372 may be slidably mounted within the interior of the rotatable spray arm 334 for movement between multiple positions. The outlets 360 of the rotatable spray arm 334 and the openings 374 of the valve body 370 may be spaced and located in any suitable manner to create any variety of sprays, patterns, and pressures of sprays as the valve body 370 moves through its various positions.

Figure 8:
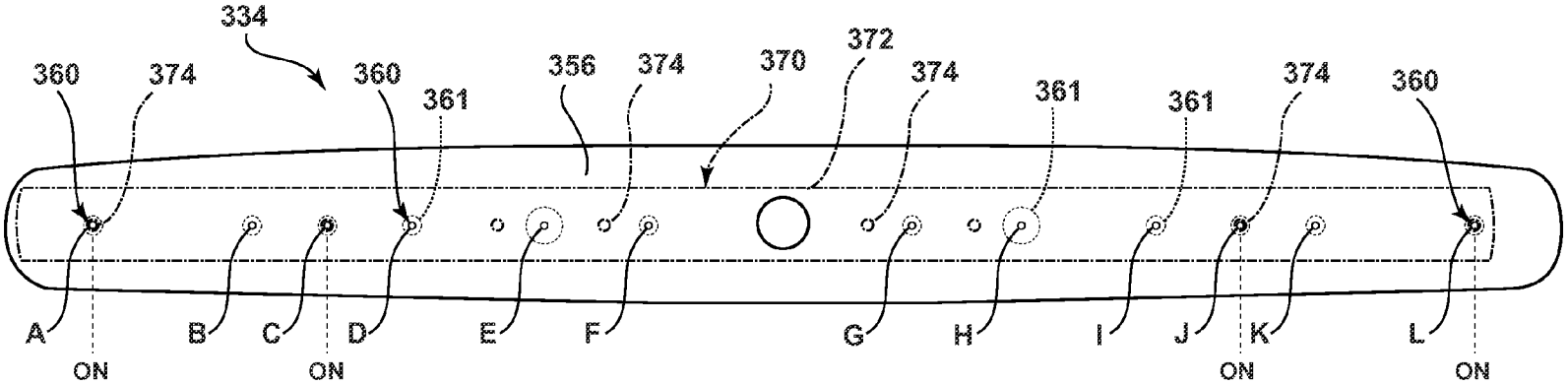
FIG. 8. is a schematic top view of the lower spray arm of FIG. 7 with a valve body in a first position.
Figure 9:
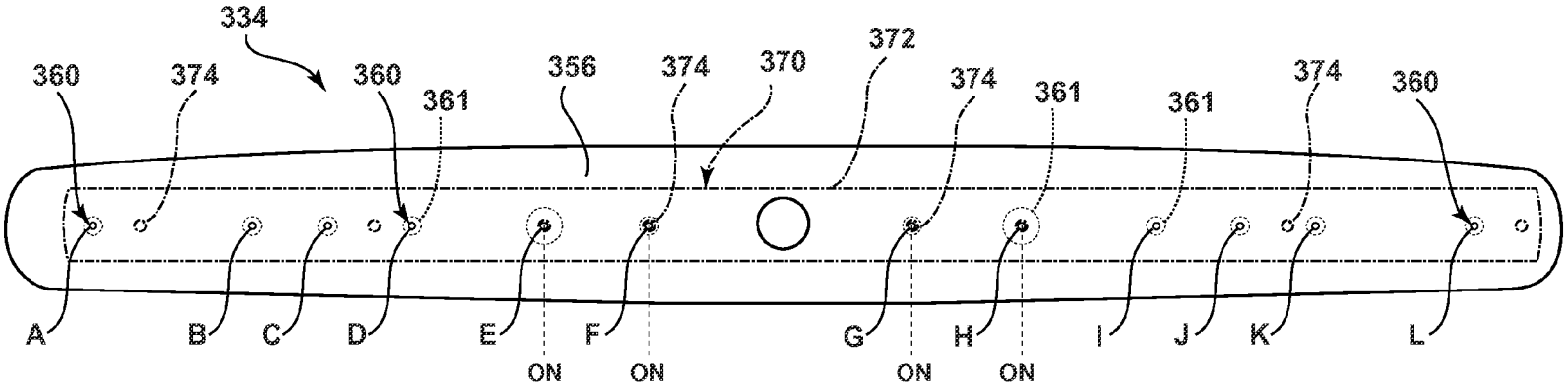
FIG. 9. is a schematic top view of the lower spray arm of FIG. 7 with the valve body in a second position.
Figure 10:
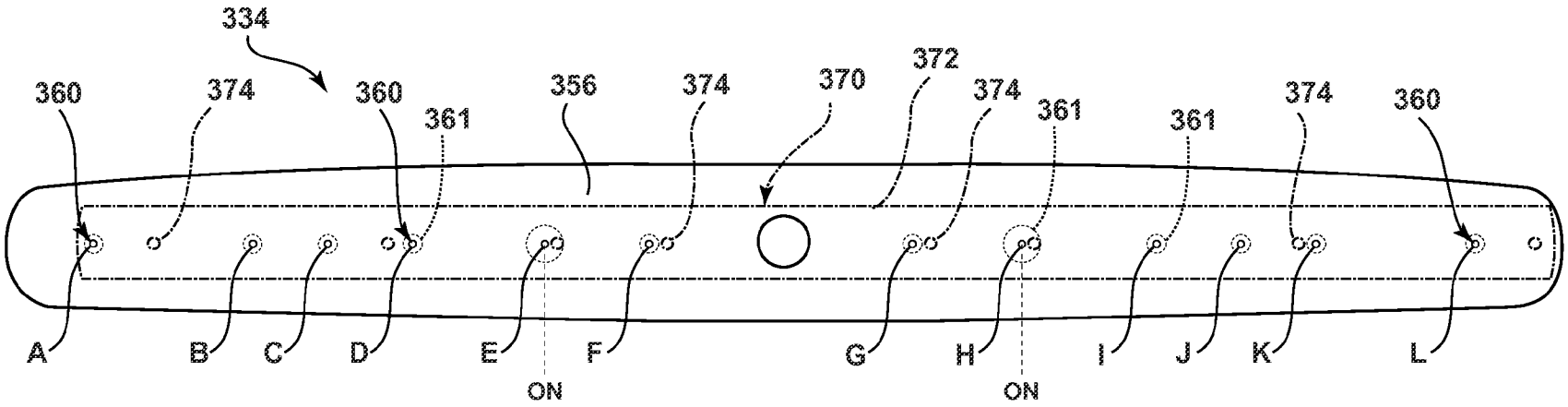
FIG. 10. is a schematic top view of the lower spray arm of FIG. 7 with the valve body in a third position.

As an example, FIG. 8. illustrates which outlets 360 may be open to the interior of the exemplary rotatable spray arm 334 when the exemplary valve body 370 is in a first position, FIG. 9. illustrates which outlets 360 may be open to the interior of the rotatable spray arm 334 when the valve body 370 is in a second position, and FIG. 10. illustrates which outlets 360 may be open to the interior of the rotatable spray arm 334 when the valve body 370 is a third position. During operation, the lower rotatable spray arm 334, valve body 370, and actuator (not shown) operate much the same as in the first embodiment wherein as the lower rotatable spray arm 334 is rotated, gears in the gear assembly (not shown) are driven and the valve body 370 is moved between the first, second, and third positions. Alternatively, a gear assembly similar to that of the second embodiment may be used to achieve a higher gear reduction and longer dwell time. Further, still any suitable gear assembly or actuator may be used to move the valve body 370.

Beginning with the valve body 370 in the first position, illustrated in FIG. 8, four of the eight openings 374 in the valve body 370 align with four of the nozzles in the lower rotatable spray arm 334. Such outlets 360 have been denoted with the identifier "ON." More specifically, the openings 374 align with the sealing rings 361 of outlets A, C, J, and L to allow liquid to spray out of the outlets 360. As the valve body 370 is moved to the second position as illustrated in FIG. 9, the outlets A, C, J, and L are no longer fluidly coupled to the interior of the lower rotatable spray arm 334. Instead four of the eight openings 374 in the valve body 370 align with four other of the outlets 360 in the lower rotatable spray arm 334. More specifically, the openings 374 align with the outlets E, F, G, and H. As illustrated, the outlets A, C, J, and L spans a different amount of the lower rotatable spray arm 334 than the outlets E, F, G, and H.

When the valve body 370 moves to the third position, illustrated in FIG. 10, only two of the eight openings 374 in the valve body 370 align with two of the outlets 360 in the lower rotatable spray arm 334. More specifically, two of the openings 374 align with the outlets E and H. Outlets E and H are a subset of the outlets E, F, G, and H. Clearly the subset including outlets E and H have fewer outlets 350 then the subset of outlets E, F, G, and H. Outlets E, F, G, and H spans a greater radial distance along the lower rotatable spray arm 334 than the outlets E and H. As the sealing rings 361 of the outlets E and H are larger those outlets 360 are fluidly coupled with the interior of the lower rotatable spray arm 334 for a longer period of time, and thus to spray liquid for a longer period of time. Because only two outlets 360 are open the interior of the lower rotatable spray arm this position creates a higher pressure spray than the other illustrated positions. The actual time or amount of revolutions that the liquid is sprayed from each of the outlets 360 may be altered based on the design of the lower rotatable spray arm 334, valve body 370, etc.

In this manner, it is contemplated that through various movement of the valve body 370 that a variety of subsets of the outlets 360 may be fluidly coupled to the liquid passage and that this may cause a pressure of liquid emanating from the outlets 360 to vary. In the illustrated example of FIG. 10 both the number of outlets 360 and the open area or cumulative cross-sectional area of the outlets 360 was changed. The first subset of the plurality of outlets 360, outlets E and H, have less cumulative cross-sectional area than a second subset of the plurality of outlets 360, formed by outlets E, F, G, and H. In this manner, the liquid emitted from the first subset of the plurality of outlets may be at a cumulative speed or cumulative pressure greater than the second subset. Because the same number and cross-sectional area of outlets are not always spraying liquid an unbalanced configuration may be formed resulting in the pressure of the liquid emanated from the outlets 360 to be varied. In the illustrated example, all of the outlets of outlets 360 have the same cross-sectional area; however, it will be understood that instead of varying the number of outlets 360 open at any one time, the cumulative cross-sectional area of the outlets 360 fluidly coupled with the interior of the lower rotatable spray arm 334 may be changed but the number of outlets 360 fluidly coupled with the interior of the lower rotatable spray arm 334 may remain the same. This will also have the effect of liquid being emitted from at least one of the outlets of the first subset, having less cumulative cross-sectional area, at a greater pressure or speed than from at least one of the outlets of the second subset, having a greater cumulative cross-sectional area. Further, both the number of outlets and the cumulative cross-sectional area may be changed.

It will be understood that the outlets 360 and the openings 374 in the valve body 370 may be arranged in a variety of ways to create a multitude of different phases and spray pressures. Further, the subsets of nozzles open during any position of the valve body may be sequentially adjacent each other or may be spaced from each other depending upon the arrangement of outlets 360 and openings 374. Further, the force and shape of the pattern of the sprays emitted from the outlets 360 may also change with movement of the valve body 370.

There are several advantages of the present disclosure arising from the various features of the apparatuses described herein. For example, the embodiments described above allow for additional coverage of the treating chamber 20 with multiple spray patterns. The first and second embodiments allow for multiple types of spray nozzles having multiple spray patterns, which may be used during a cycle of operation, which in turn may result in better cleaning of utensils within the treating chamber 20 with no additional liquid consumption. Further, because the lower rotatable sprayers have multiple subsets of outlets and each multiple subset has a smaller total nozzle area than current spray arm designs, lower flow rates may be used and this may result in less liquid or water being required. This may increase the velocity of the spray emitted from each of the first and second subsets of nozzles while not sacrificing coverage or individual nozzle size. Further, with less liquid flow needed, a smaller recirculation pump having a smaller motor may also be used which may result in a cost and energy savings. The third embodiment described above allows for a single type of nozzle which emits varying spray patterns, including sprays in different directions and having different intensities, which may result in additional coverage of the treating chamber 20 and better cleaning of utensils within the treating chamber 20 with no additional liquid consumption. Further, the fourth embodiment described above allows for a wash zone having a higher pressure for tougher soil to be created.

While the invention has been specifically described in connection with certain specific embodiments thereof, it is to be understood that this is by way of illustration and not of limitation. For example, it has been contemplated that the valve body and actuator may be located in other rotatable spray arms such as a mid-level rotatable spray arm. Further, other actuators may be used to control the movement of the valve body based on the rotation of the lower rotatable spray arm and the illustrated actuators including gear assemblies are merely exemplary. Further, although both gear assemblies illustrated include the same number of gears, it has been contemplated that the gear assembly may include any number of gears. Further, even though the gear assemblies are shown in a stacked configuration they could organized in a more horizontal layout.

Further, while the valve body has been illustrated and described as moving in a linear motion it is contemplated that the valve body may alternatively be moved in an orbital motion. Such a motion could be created in a variety of ways including, by way of non-limiting example, replacing the pin described above with a pivot pin, which is mounted to the valve body slightly off center of the final gear, which would allow the plate to orbit. Alternatively, one end of the valve body may have a pin in a short longitudinal slot defining one end, while the other end orbits. As yet another non-limiting alternative, an additional gear may be added in the same plane as the fourth gear and may be of the same size and thus rotate at a synchronized speed with the fourth gear. A pin may be included on this additional gear and may orbit in unison with and retain a constant distance from the other pin. Since the valve plate is engaged to both pins the entire plate would be caused to orbit. With the valve body, or a portion of the valve body, capable of orbital motion the multiple openings may be dispersed in a two-dimension plane in a wider variety of ways such that the outlets could be changed when the valve body orbits. Further, the valve body could be made to orbit around the multiple openings to allow for sprays in all directions.

Further still, while the sprayer has been illustrated and described as a rotatable spray arm it will be understood that any suitable sprayer may be used. For example, a non-rotatable spray arm may be used and the actuator may move the valve body within the spray arm. Further, a sprayer having a different shape may be used and may be either rotatable or non-rotatable. Similarly, while the valve body has been described and illustrated as a slidable plate it is contemplated that the valve body may take any suitable form and that the slidable plate may take any suitable form. For example, the slidable plate may include a rigid plate, a flexible plate, or a thin film plate, which may be either flexible or rigid. Further, it will be understood that any features of the above described embodiments may be combined in any manner.

The patentable scope of the invention is defined by the claims, and may include other examples that occur to those skilled in the art. Reasonable variation and modification are possible within the scope of the forgoing disclosure and drawings without departing from the spirit of the invention which is defined in the appended claims.

What is claimed is:

1. A dishwasher for washing utensils according to an automatic cycle of operation, comprising:

a tub at least partially defining a treating chamber for receiving utensils for cleaning;

a spraying system for supplying liquid to the treating chamber and having a sprayer comprising:

a rotatable body having an interior;

a liquid passage provided in the interior;

a plurality of outlets extending through the rotatable body and in fluid communication with the liquid passage;

a valve body selectively fluidly coupling the plurality of outlets to the liquid passage and reciprocally moveable between at least two positions, with one of the at least two positions fluidly coupling a first subset of the plurality of outlets to the liquid passage, and a second of the at least two positions fluidly coupling a second subset of the plurality of outlets to the liquid passage, with the second subset differing from the first subset by at least one of the plurality of outlets; and an actuator operably coupled to the rotatable body of the sprayer and operably coupled to the valve body via a mechanical linkage and configured to reciprocally move the valve body between the at least two positions based on the rotation of the rotatable body.

2. The dishwasher of claim 1 wherein the rotatable body of the sprayer comprises a rotatable spray arm.

3. The dishwasher of claim 2 wherein the actuator is operably coupled to the rotatable spray arm and moves the valve body between the at least two positions based on a rotational position of the rotatable spray arm.

4. The dishwasher of claim 3 wherein the valve body is moved between the at least two positions by the actuator over multiple rotations of the rotatable spray arm.

5. The dishwasher of claim 3 wherein the actuator comprises a drive system operably coupling the rotatable spray arm and the valve body such that rotation of the rotatable spray arm moves the valve body between the at least two positions.

6. The dishwasher of claim 5, further comprising a motor operably coupled to the rotatable spray arm to rotate the rotatable spray arm.

7. The dishwasher of claim 5 wherein the drive system further comprises a gear assembly operably coupling the rotatable spray arm and the valve body such that rotation of the rotatable spray arm moves the gear assembly which in turn moves the valve body between the at least two positions.

8. The dishwasher of claim 7 wherein the gear assembly comprises a gear chain forming a reduction gear assembly.

9. The dishwasher of claim 8 wherein the reduction gear assembly provides at least a 40:1 gear reduction.

10. The dishwasher of claim 7 wherein the valve body comprises a slidable plate having multiple openings that align with the first and second subset of outlets in the corresponding at least two positions.

11. The dishwasher of claim 10 wherein the gear assembly is operably coupled to the slidable plate such that the rotation of the gear assembly is converted into translational movement of the slidable plate.

12. The dishwasher of claim 11 wherein the gear assembly comprises a pin coupled to a gear and the slidable plate further comprises a channel receiving the pin such that the rotation of the gear assembly is converted into the translational movement of the slidable plate through the movement of the pin within the channel.

13. The dishwasher of claim 7 wherein the drive system further comprises a fixed shaft on which is fixedly mounted a gear of the gear assembly.

14. The dishwasher of claim 13 wherein the rotatable spray arm is rotationally mounted to the fixed shaft.

15. The dishwasher of claim 7, further comprising a bracket located within the interior and operably coupled to the gear assembly to provide support for the gear assembly.

16. The dishwasher of claim 5, further comprising a hydraulic drive formed by at least one of the plurality of outlets being oriented such that liquid emitted from the hydraulic drive effects the rotation of the rotatable spray arm.

17. The dishwasher of claim 1 wherein the valve body comprises a slidable plate having multiple openings that align with the first and second subset of outlets in the corresponding at least two positions.

18. The dishwasher of claim 17 wherein the slidable plate is slidably mounted within the interior of the rotatable body of the sprayer for slidable movement between at least two positions.

19. The dishwasher of claim 1 wherein the first subset of the plurality of outlets has less cumulative cross-sectional area than the second subset of the plurality of outlets to provide for liquid being emitted from at least one of the outlets of the first subset at least one of a greater pressure and a greater speed than from at least one of the outlets of the second sub set.

20. The dishwasher of claim 19 wherein the liquid emitted from the first subset of the plurality of outlets is at a cumulative speed or cumulative pressure greater than the second subset.

21. The dishwasher of claim 19 wherein the first subset has fewer outlets than the second subset.

22. The dishwasher of claim 21 wherein all of the plurality of outlets have the same cross-sectional area.

23. The dishwasher of claim 19 wherein the first subset spans a different amount of body than the second subset.

24. The dishwasher of claim 23 wherein the first subset is a subset of the second subset.

25. The dishwasher of claim 23 wherein the rotatable body comprises an arm rotating about an axis of rotation and the first subset spans a different radial amount of the arm relative to the axis of rotation than the second subset.

26. The dishwasher of claim 25 wherein the first subset is a subset of the second subset.

27. The dishwasher of claim 26 wherein the second subset spans a greater radial distance along the arm than the first subset.

* * * * *